US012352456B2

(12) United States Patent
Cai et al.

(10) Patent No.: US 12,352,456 B2
(45) Date of Patent: Jul. 8, 2025

(54) CONTROL METHOD FOR AIR CONDITIONER INDOOR UNIT

(71) Applicant: GD MIDEA AIR-CONDITIONING EQUIPMENT CO., LTD., Guangdong (CN)

(72) Inventors: Guojian Cai, Guangdong (CN); Zhouheng Tan, Guangdong (CN)

(73) Assignee: GD MIDEA AIR-CONDITIONING EQUIPMENT CO., LTD., Guangdong (CN)

( * ) Notice: Subject to any disclaimer, the term of this patent is extended or adjusted under 35 U.S.C. 154(b) by 0 days.

(21) Appl. No.: 18/602,518

(22) Filed: Mar. 12, 2024

(65) Prior Publication Data

US 2024/0219062 A1 Jul. 4, 2024

Related U.S. Application Data

(60) Division of application No. 17/215,459, filed on Mar. 29, 2021, now Pat. No. 11,959,658, which is a (Continued)

(30) Foreign Application Priority Data

Sep. 30, 2018 (CN) ..... 201811161669.3
Sep. 30, 2018 (CN) ..... 201811163007.X
(Continued)

(51) Int. Cl.
*F24F 11/79* (2018.01)
*F24F 1/00* (2019.01)
(Continued)

(52) U.S. Cl.
CPC ..... *F24F 11/79* (2018.01); *F24F 1/0011* (2013.01); *F24F 11/65* (2018.01); *F24F 13/222* (2013.01); *F24F 11/56* (2018.01); *F24F 2221/22* (2013.01)

(58) Field of Classification Search
CPC ..... F24F 1/0011; F24F 11/56; F24F 11/65; F24F 11/79; F24F 13/22; F24F 2221/22
See application file for complete search history.

(56) References Cited

U.S. PATENT DOCUMENTS 8,647,404 B2 * 2/2014 Yumoto ..... B01D 46/681 55/471
8,734,553 B2 * 5/2014 Sakashita ..... F24F 1/0063 55/296
(Continued)

FOREIGN PATENT DOCUMENTS

CN 206919143 U 1/2018
CN 108105846 A 6/2018
(Continued)

OTHER PUBLICATIONS

International Search Report dated Jun. 26, 2019 received in International Application No. PCT/CN2019/084281.
(Continued)

*Primary Examiner* — Marc E Norman
(74) *Attorney, Agent, or Firm* — Scully, Scott, Murphy & Presser, P.C.

(57) ABSTRACT

A control method for an air conditioner indoor unit is provided. The air conditioner indoor unit has a housing, a drain pan, an air deflector, a door, and a sweeping strip. In a wind-free mode of the indoor unit, an orthographic projection of the air deflector in the drain pan is located in the drain pan. According to the method, the air conditioner indoor unit enables the non-draught mode; when receiving an instruction of ending the non-draught mode, the air
(Continued)

conditioner indoor unit controls the door to move back and forth for n times to close and open the air outlet, so as to drive the sweeping strip to move to sweep the condensate water on the surface of the air deflector, n being greater than 0; and the wind-free mode is ended.

10 Claims, 13 Drawing Sheets

Related U.S. Application Data continuation of application No. PCT/CN2019/084281, filed on Apr. 25, 2019.

(30) Foreign Application Priority Data

Sep. 30, 2018 (CN) ..... 201811163019.2
Sep. 30, 2018 (CN) ..... 201811163053.X

(51) Int. Cl.

*F24F 1/0011* (2019.01)
*F24F 11/65* (2018.01)
*F24F 13/22* (2006.01)
*F24F 11/56* (2018.01)

(56) References Cited

U.S. PATENT DOCUMENTS

2006/0096459 A1* 5/2006 Iwano ..... F24F 1/0073 55/296
2009/0183471 A1* 7/2009 Shibuya ..... F24F 1/0057 55/282.2
2010/0107575 A1* 5/2010 Zhang ..... B01D 46/681 55/289
2010/0294134 A1* 11/2010 Yokomizo ..... F24F 1/0073 96/405
2011/0120066 A1* 5/2011 Sakashita ..... B01D 46/681 55/282.2
2012/0180665 A1* 7/2012 Jeong ..... F24F 1/0047 55/289
2015/0114232 A1* 4/2015 Pan ..... B01D 46/0054 55/296
2020/0155992 A1* 5/2020 Park ..... B01D 46/10
2020/0166223 A1* 5/2020 Zhu ..... F24F 13/14

FOREIGN PATENT DOCUMENTS

| | | | |
|---|---|---|---|
| CN | 108278675 | A | 7/2018 |
| CN | 108413525 | A | 8/2018 |
| CN | 207850113 | U | 9/2018 |
| CN | 207922500 | U | 9/2018 |
| CN | 109323411 | A | 2/2019 |
| CN | 109323412 | A | 2/2019 |
| CN | 109323413 | A | 2/2019 |
| CN | 109341016 | A | 2/2019 |
| JP | 2007-322103 | A | 12/2007 |
| JP | 2008-224150 | A | 9/2008 |
| JP | 2016-223679 | A | 12/2016 |
| KR | 2001-0037408 | A | 5/2001 |

OTHER PUBLICATIONS

First Office Action dated Jul. 15, 2019 received in Chinese Patent Application No. CN 201811163053.X.
First Office Action dated Jul. 18, 2019 received in Chinese Patent Application No. CN 201811161669.3.
First Office Action dated Jul. 18, 2019 received in Chinese Patent Application No. CN 201811163007.X.
Supplementary European Search Report dated Nov. 3, 2021 received in European Patent Application No. EP 19864515.2.
Decision to Grant Patent dated Aug. 25, 2022 received in European Patent Application No. EP 19864515.2.
Third Office Action dated Sep. 25, 2020 received in Chinese Patent Application No. CN 201811161669.3.
Second Office Action dated Feb. 28, 2020 received in Chinese Patent Application No. CN 201811161669.3.
Notification to Grant Patent Right for Invention dated Sep. 25, 2020 received in Chinese Patent Application No. CN 201811161669.3.
Third Office Action dated Sep. 25, 2020 received in Chinese Patent Application No. CN 201811163007.X.
Second Office Action dated Feb. 28, 2020 received in Chinese Patent Application No. CN 201811163007.X.
Notification to Grant Patent Right for Invention dated Feb. 20, 2021 received in Chinese Patent Application No. CN 201811163007.X.
First Office Action dated Mar. 30, 2020 received in Chinese Patent Application No. CN 201811163019.2.
Notification to Grant Patent Right for Invention dated Nov. 27, 2020 received in Chinese Patent Application No. CN 201811163019.2.
Notice of Allowance dated Dec. 15, 2023 received in U.S. Appl. No. 17/215,459.
Second Office Action dated Feb. 28, 2020 received in Chinese Patent Application No. CN 201811163053.X.
Third Office Action dated Sep. 25, 2020 received in Chinese Patent Application No. CN 201811163053.X.
Notification to Grant Patent Right for Invention dated Feb. 20, 2021 received in Chinese Patent Application No. CN 201811163053.X.

* cited by examiner

CONTROL METHOD FOR AIR CONDITIONER INDOOR UNIT

CROSS-REFERENCE TO RELATED APPLICATIONS

The present application is a divisional application of U.S. Ser. No. 17/215,459, filed on Mar. 29, 2021, which is a continuation application of PCT International Application No. PCT/CN2019/084281, filed on Apr. 25, 2019, which claims priority to and benefits of Chinese Patent Applications No. 201811161669.3, 201811163053.X, 201811163007.X, and 201811163019.2, filed on Sep. 30, 2018, the entire content of which is incorporated herein by reference for all purposes. No new matter has been introduced.

FIELD

The present disclosure relates to the field of air conditioning technologies, and more particularly to a control method for an air-conditioner indoor unit.

BACKGROUND

When an air-conditioner indoor unit performs a windless cooling, the condensate water may be formed on an air deflector, and the condensate water may drop to the floor, so that a security risk exists, which may lead to complains from users. In the related art, the condensation phenomenon generally can be reduced by increasing a temperature of an air outlet of the air-conditioner indoor unit or reducing a rotation speed of a wind wheel, but this will cause a poor cooling performance of the air-conditioner indoor unit and hence affect the user's experience.

SUMMARY

The aim of the present disclosure is to solve at least one problem in the related art. For this, the present disclosure provides a control method for an air-conditioner indoor unit, which can achieve an air output with a windless or wind-free feeling of the air-conditioner indoor unit without sacrificing a cooling capacity of an air conditioner, and also avoids the condensate water on an air deflector from dropping to the ground.

The present disclosure further provides a control method for an air-conditioner indoor unit, which avoids disassembling the air-conditioner indoor unit when removing the dust from the air deflector, and allows it to be unnecessary to remove the dust from the air deflector manually, thus improving the use experience of the user.

In the control method for the air-conditioner indoor unit according to embodiments of the present disclosure, the air-conditioner indoor unit includes a housing, a drain pan, an air deflector, a movable cover plate, and a sweeping strip, the housing has an air outlet, the air deflector is rotatably arranged at the air outlet, the air deflector is provided with micro holes, the movable cover plate is movably arranged at a front side of the housing to open or close the air outlet, the sweeping strip is attached to the movable cover plate and configured to sweep a condensate water on the air deflector, the drain pan is arranged at a bottom of the air outlet and configured to receive the condensate water from the air deflector, and an orthographic projection of the air deflector on the drain pan is located in the drain pan in a windless or wind-free feeling mode. The control method includes: S10: starting the windless or wind-free feeling mode by the air-conditioner indoor unit; S20: when the air-conditioner indoor unit receives an instruction of ending the windless or wind-free feeling mode, controlling the movable cover plate to move back and forth between closing the air outlet and opening the air outlet for n times, so as to drive the sweeping strip to move to sweep the condensate water on a surface of the air deflector, wherein $n>0$; and S30: ending the windless or wind-free feeling mode.

In the control method for the air-conditioner indoor unit according to the embodiments of the present disclosure, when receiving the instruction of ending the windless or wind-free feeling mode, the air condition indoor unit controls the movable cover plate to move back and forth between closing the air outlet and opening the air outlet for n times, so as to drive the sweeping strip to move to sweep the condensate water on the surface of the air deflector, thereby realizing the air output with the windless or wind-free feeling of the air condition indoor unit without sacrificing the cooling capacity of the air conditioner, and avoiding the condensate water on the air deflector from dropping to the ground.

In some embodiments of the present disclosure, n satisfies: $1 \leq n \leq 3$.

In some embodiments of the present disclosure, the air deflector includes a plurality of sub air deflectors, and the plurality of sub air deflectors are arranged at the air outlet and spaced apart from one another.

In some embodiments of the present disclosure, the sweeping strip is a flexible member.

In some embodiments of the present disclosure, the sweeping strip is a rubber member or a silica gel member.

In some embodiments of the present disclosure, two movable cover plates and two sweeping strips are provided, the two movable cover plates are in a one-to-one correspondence with the two sweeping strips, and the two movable cover plates are spaced apart from each other in a left-right direction.

In some embodiments of the present disclosure, a rear surface of the movable cover plate is provided with a reinforcing rib, and the sweeping strip is attached to the reinforcing rib.

In some embodiments of the present disclosure, one end of the sweeping strip is snap-engaged with the reinforcing rib and the other end of the sweeping strip extends rearwards.

In some optional embodiments of the present disclosure, the reinforcing rib is provided with a catching groove, and the one end of the sweeping strip is provided with an engaging portion fitted with the catching groove.

In some embodiments of the present disclosure, opposite inner side walls of an opening end of the catching groove are provided with turnups extending in a direction of approaching each other, and the engaging portion has step surfaces fitted with the turnups.

In some embodiments of the present disclosure, the air-conditioner indoor unit includes an air-deflector motor configured to drive the air deflector to rotate, and step S20 includes: S21: when the air-conditioner indoor unit receives the instruction of ending the windless or wind-free feeling mode, controlling the air-deflector motor to generate a motor stalling; S22: controlling the movable cover plate to move back and forth between closing the air outlet and opening the air outlet for n times, so as to drive the sweeping strip to move to sweep the condensate water on the surface of the deflector.

In some embodiments of the present disclosure, when the orthographic projection of the air deflector on the drain pan is located in the drain pan, a maximum rotation angle of the air deflector is $\alpha_0$, and step S20 includes: S21: when the air-conditioner indoor unit receives the instruction of ending the windless or wind-free feeling mode, ending the windless or wind-free feeling mode and controlling the air deflector to rotate back and forth between $\alpha_1$ and $\alpha_2$ for m times, wherein $0° \leq \alpha_1 < \alpha_2 \leq \alpha_0$; S22: entering the windless or wind-free feeling mode and controlling the movable cover plate to move back and forth between closing the air outlet and opening the air outlet for n times, so as to drive the sweeping strip to move to sweep the condensate water on the surface of the air deflector.

In some embodiments of the present disclosure, m satisfies: $2 \leq m \leq 5$.

In some embodiments of the present disclosure, $\alpha_0$ satisfies: $\alpha_0 \leq 20°$.

In some embodiments of the present disclosure, $\alpha_1 = 0°$, $\alpha_2 = \alpha_0$.

In some embodiments of the present disclosure, $\alpha_1$ satisfies: $0° \leq \alpha_1 \leq 5°$.

In the control method for the air-conditioner indoor unit according to the embodiments of the present disclosure, the air-conditioner indoor unit includes a housing, a wind wheel, an air deflector, a movable cover plate, and a sweeping strip, the housing has an air outlet, the air deflector is rotatably arranged at the air outlet, the movable cover plate is movably arranged at a front side of the housing to open or close the air outlet, and the sweeping strip is attached to the movable cover plate and configured to sweep dust on the air deflector. The control method includes: A10: starting a function of cleaning the air deflector; A20: controlling the air deflector to rotate to close the air outlet; A30: controlling the movable cover plate to move, so as to drive the sweeping strip to move to sweep the dust on a surface of the air deflector; A40: ending the function of cleaning the air deflector.

In the control method for the air-conditioner indoor unit according to the embodiments of the present disclosure, by controlling the movable cover plate to move, so as to drive the sweeping strip to move to sweep the dust on the surface of the air deflector, the air-conditioner indoor unit can be prevented from being disassembled when the dust is to be removed from the air deflector, and it is not necessary to remove the dust from the air deflector manually, thus improving the use experience of the user.

In some embodiments of the present disclosure, between step A10 and step A20, the control method further includes: A11: controlling the air deflector to rotate to a predetermined angle $\lambda$ so as to partly open the air outlet and controlling a rotation speed of the wind wheel to increase by F r/min, wherein $F>0$.

In some embodiments of the present disclosure, between step A11 and step A20, the control method further includes: A12: after t min, controlling the rotation speed of the wind wheel to reduce by X r/min, wherein $X \geq F$, $t>0$.

In some embodiments of the present disclosure, at S12, after t min, the rotation speed of the wind wheel is controlled to reduce to a lowest rotation speed.

In some embodiments of the present disclosure, $5 \leq t \leq 25$.

In some embodiments of the present disclosure, $25 \leq F \leq 70$.

In some embodiments of the present disclosure, $45° \leq \lambda \leq 90°$.

In some embodiments of the present disclosure, at step A30, the movable cover plate is controlled to move back and forth between opening the air outlet and closing the air outlet for k times, $k>0$.

In some embodiments of the present disclosure, when an instruction of turning on the air-conditioner indoor unit is received, the function of cleaning the air deflector is started.

In some embodiments of the present disclosure, when an instruction of turning off the air-conditioner indoor unit is received, the function of cleaning the air deflector is first started to clean the air deflector, and the air-conditioner indoor unit is turned off after the function of cleaning the air deflector is ended.

Additional aspects and advantages of embodiments of present disclosure will be given in part in the following descriptions, become apparent in part from the following descriptions, or be learned from the practice of the embodiments of the present disclosure.

BRIEF DESCRIPTION OF THE DRAWINGS

These above and/or additional aspects and advantages of embodiments of the present disclosure will become apparent and more readily appreciated from the following descriptions made with reference to the accompanying drawings, in which.

Figure 1:
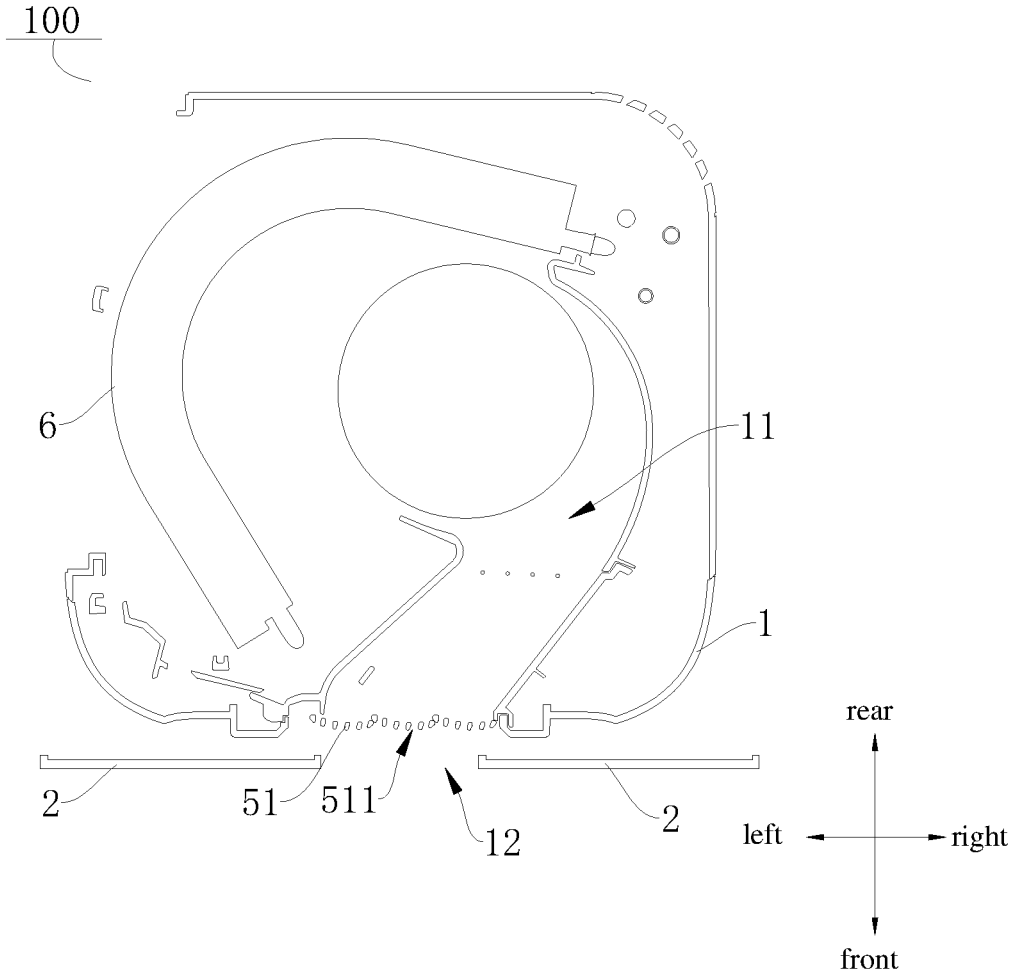
FIG. 1 is a schematic view illustrating a state of an air-conditioner indoor unit according to an embodiment of the present disclosure, in which a movable cover plate is in an open state, and an air deflector closes an air outlet.

REFERENCE NUMERALS air-conditioner indoor unit 100;
housing 1; air duct 11; air outlet 12;
movable cover plate 2; reinforcing rib 21; catching groove 211; turnup 212;
sweeping strip 3; engaging portion 31; step surface 311; drive device 4;
air deflector 5; sub air deflector 51; micro hole 511;
indoor heat exchanger 6; drain pan 7.

DETAILED DESCRIPTION OF EMBODIMENTS

Embodiments of the present application will be described in detail below, and the examples of the embodiments will be illustrated in the drawings. The same or similar elements and the elements having same or similar functions are denoted by like reference numerals throughout the description. The embodiments described herein with reference to the drawings are illustrative and used to generally understand the present disclosure. The embodiments shall not be constructed to limit the present disclosure.

An air-conditioner indoor unit 100 according to embodiments of the present disclosure will be described below with reference to FIGS. 1 to 9. The air-conditioner indoor unit 100 may be used to adjust a temperature of an indoor environment. For example, the air-conditioner indoor unit 100 may be a wall-mounted air conditioner unit or a packaged air conditioner unit.

As illustrated FIGS. 1 to 9, the air-conditioner indoor unit 100 is a wall-mounted air-conditioner indoor unit. The air-conditioner indoor unit 100 may include a housing 1, a drain pan 7, an air deflector 5, a movable cover plate 2, a sweeping strip 3, and an air-deflector motor (not illustrated). The housing 1 has an air outlet 12, and the air deflector 5 is rotatably arranged at the air outlet 12. The air deflector 5 is provided with micro holes 511, and the air-deflector motor is used to drive the air deflector 5 to rotate.

Figure 2:
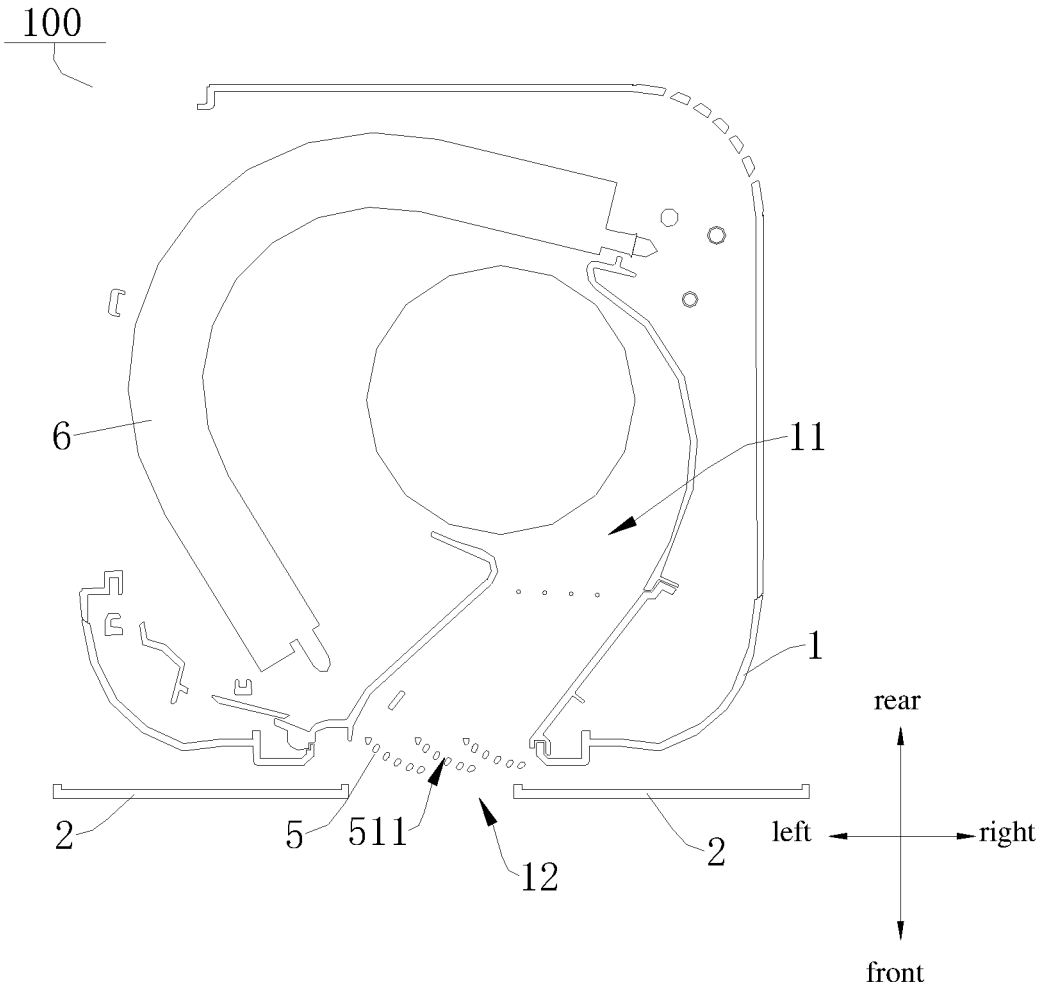
FIG. 2 is a schematic view illustrating another state of the air-conditioner indoor unit according to FIG. 1, in which the movable cover plate is in the open state, and the air deflector rotates to $\alpha_0$.

The movable cover plate 2 is movably arranged at a front side of the housing 1 to open or close the air outlet 12. The sweeping strip 3 is attached to the movable cover plate 2 and configured to sweep condensate water and/or dust on the air deflector 5, and the drain pan 7 is arranged at a bottom of the air outlet 12 to receive the condensate water of the air deflector 5. In a windless or wind-free feeling mode, an orthographic projection of the air deflector 5 on the drain pan 7 is located in the drain pan 7 (for example, as illustrated in FIG. 1, in a direction from top to bottom, a projection of the air deflector 5 on the drain pan 7 is the orthographic projection of the air deflector 5 on the drain pan 7). Moreover, as illustrated in FIG. 2, when the orthographic projection of the air deflector 5 on the drain pan 7 is located in the drain pan 7, a maximum rotation angle of the air deflector 5 is $\alpha_0$.

It should be noted that when a user faces towards the air-conditioner indoor unit 100, a direction of the user's head is up, a direction of the user's foot is down, a direction of the user's left side is left, a direction of the user's right side is right, a direction of the indoor unit proximal of the user's chest is front, and a direction facing away from or distal of the user's chest is back.

Figure 6:
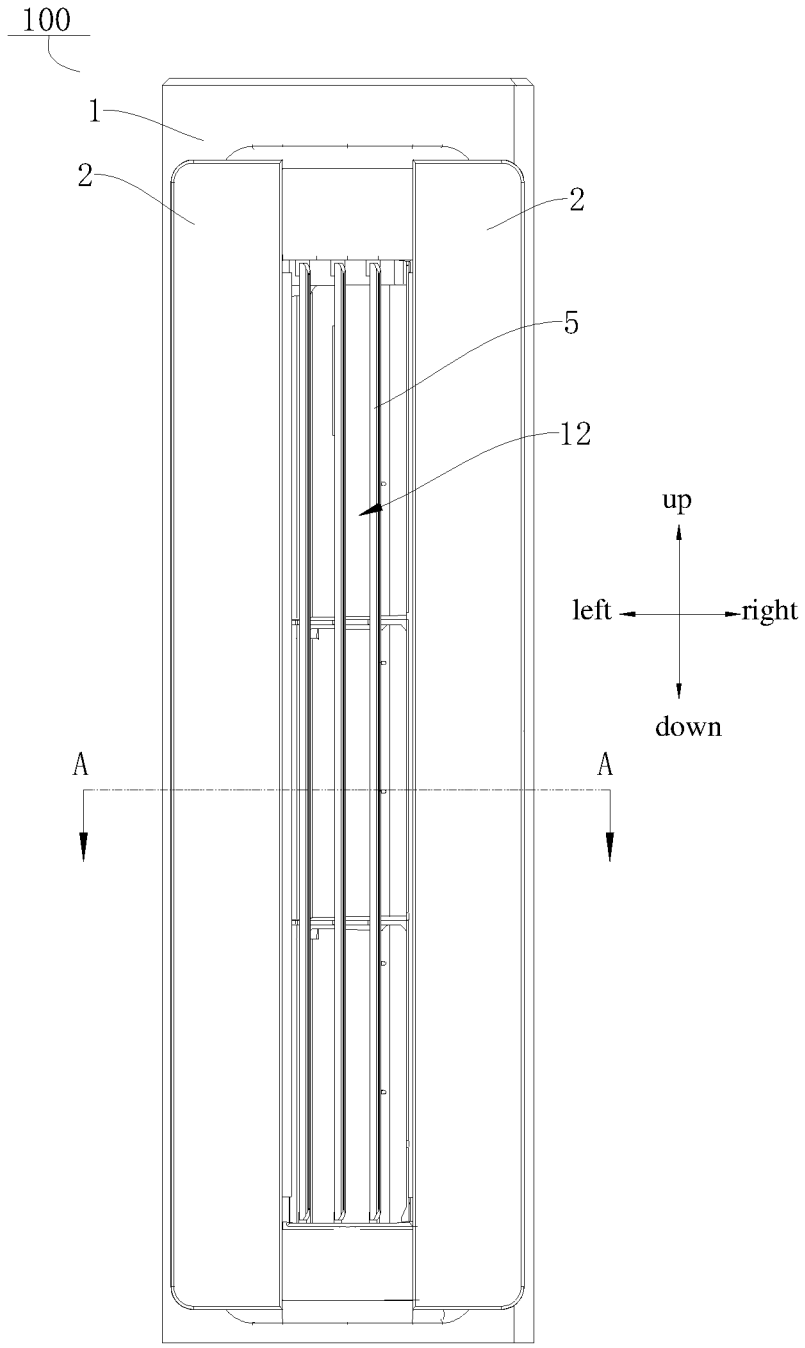
FIG. 6 is a partial schematic view of an air-conditioner indoor unit according to an embodiment of the present disclosure.

For example, as illustrated in FIGS. 1 and 6, the air outlet 12 of the housing 1 extends in an up-down direction and has a shape of an elongated strip. The air deflector 5 includes a plurality of sub air deflectors 51. The plurality of sub air deflectors 51 are arranged at the air outlet 12 and spaced apart from each other. Each sub air deflector 51 has a shape of an elongated strip and a rotation center line of the air deflector 5 extends in a vertical direction. Each sub air deflector 51 is provided with a plurality of micro holes 511, and the plurality of micro holes 511 run through the sub air deflectors 51 in a thickness direction of the sub air deflectors 51.

Figure 7:
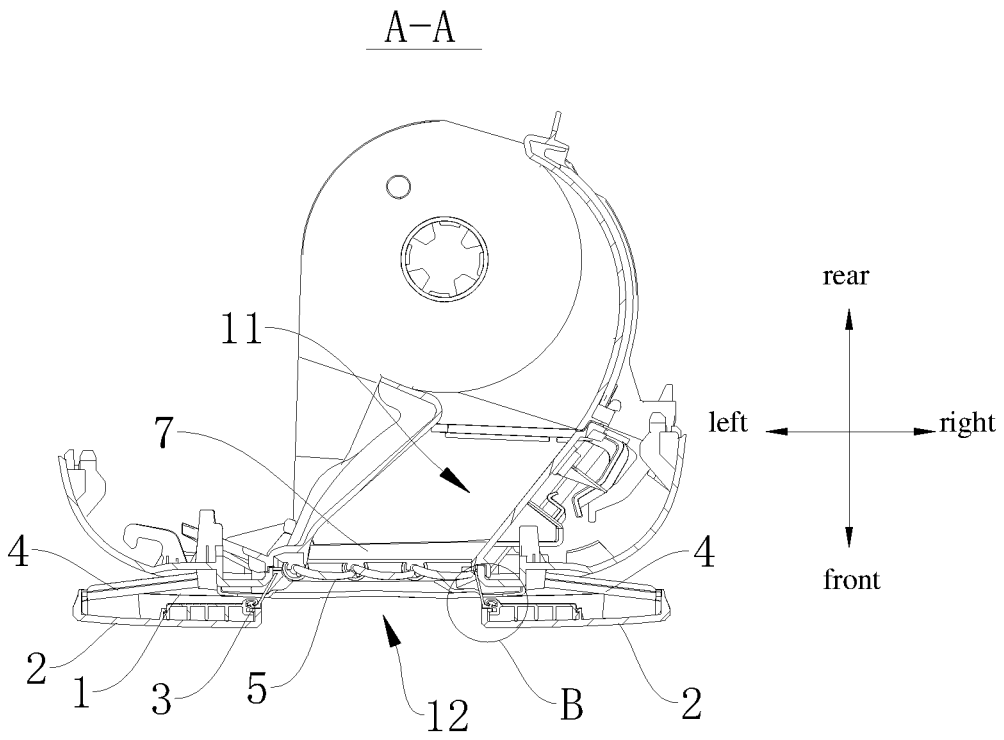
FIG. 7 is a sectional view along line A-A in FIG. 6.

Specifically, as illustrated in FIGS. 1 and 7, the air-conditioner indoor unit 100 further includes an indoor heat exchanger 6, an air duct 11, a wind wheel, and a drive device 4 for driving the movable cover plate 2 to move left and right. The wind wheel is arranged in the air duct 11. The air-conditioner indoor unit 100 can realize an air output with a windless or wind-free feeling. When the air-conditioner indoor unit 100 performs the air output with the windless or wind-free feeling, the air deflector 5 closes the air outlet 12, such that an airflow concentrated in the air duct 11 is evacuated into a plurality of fine air currents to be discharged into an indoor space, thus improving the user's comfort. The drain pan 7 is arranged at the bottom of the air outlet 12 to receive the condensate water of the air deflector 5.

Further, as illustrated in FIG. 7, the movable cover plate 2 is movably arranged at the front side of the housing 1 to open or close the air outlet 12, and the sweeping strip 3 is provided to the movable cover plate 2 and configured to sweep the condensate water of the air deflector 5. Two movable cover plates 2 and two sweeping strips 3 are provided in this embodiment, and the two movable cover plates 2 are in a one-to-one correspondence with the two sweeping strips 3. The two movable cover plates 2 are spaced apart from each other in a left-right direction, and the sweeping strip 3 can sweep the condensate water on the air deflector 5 into the drain pan 7.

Figure 8:
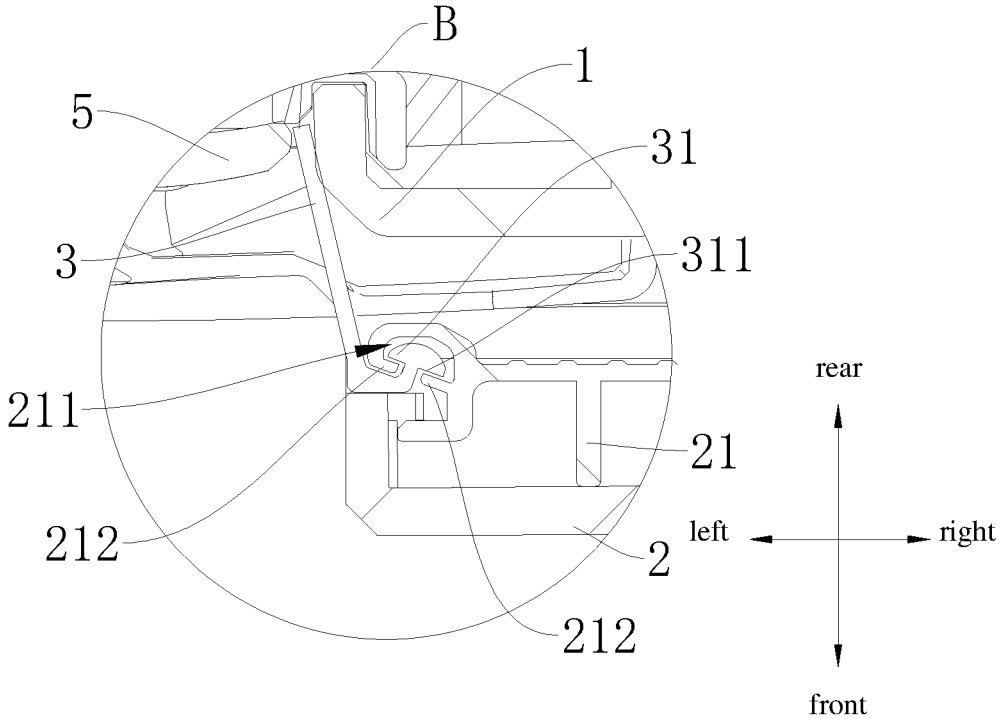
FIG. 8 is an enlarged view of portion B in FIG. 7.
Figure 9:
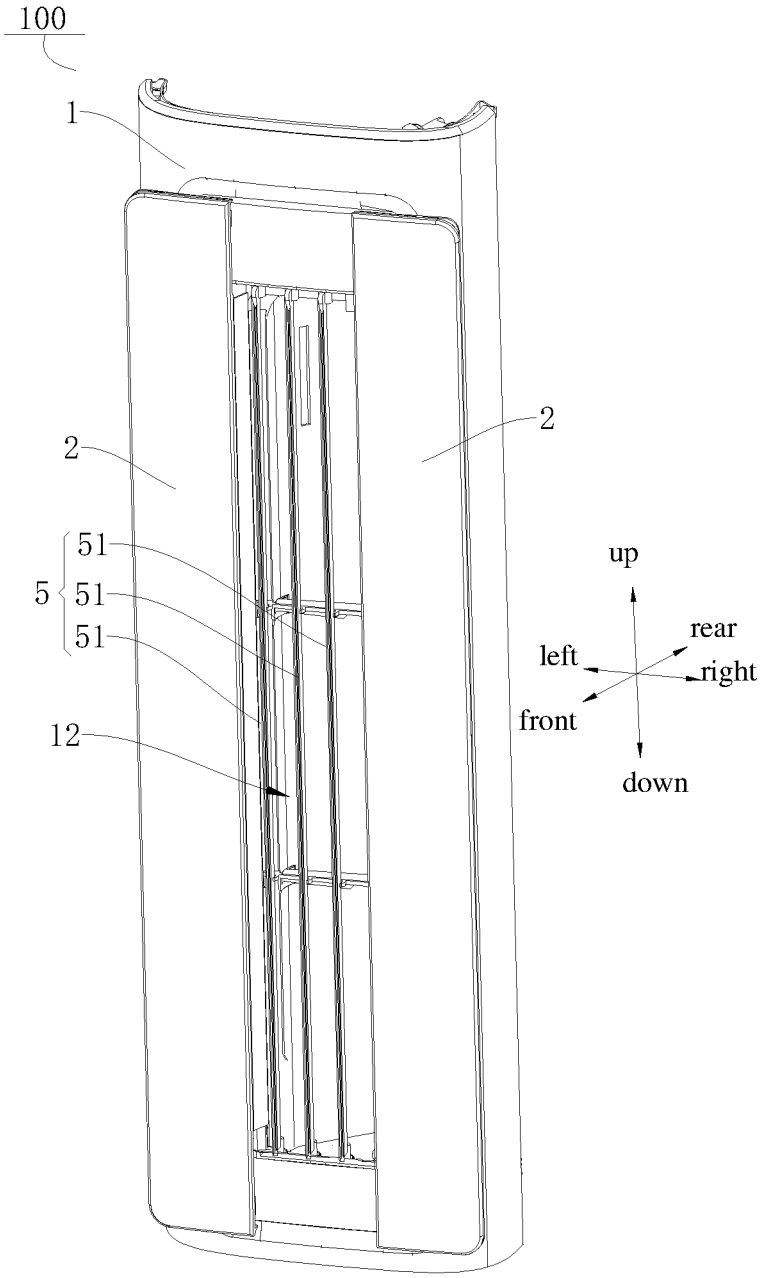
FIG. 9 is a perspective view of a partial structure of the air-conditioner indoor unit according to FIG. 6.

As illustrated in FIGS. 7 and 8, a reinforcing rib 21 is arranged on a rear surface of each movable cover plate 2, and the reinforcing rib 21 of each movable cover plate 2 is provided with a catching groove 211. Opposite inner side walls of an opening end of the catching groove 211 of each reinforcing rib 21 are provided with turnups 212 extending in a direction of approaching each other, and a front end of each sweeping strip 3 is provided with an engaging portion 31 fitted with the corresponding catching groove 211. The engaging portion 31 has step surfaces 311 fitted with the turnups 212, and a rear end of each sweeping strip 3 extends rearwards. The sweeping strip 3 is a flexible member. For example, the sweeping strip 3 may be a rubber member or a silica gel member. When the movable cover plate 2 closes the air outlet 12 or opens the air outlet 12 under the action of the drive device 4, the sweeping strip 3 contacts with the air deflector 5 to sweep the condensate water on the air deflector 5 into the drain pan 7. In should be understood that the movable cover plate 2 and the air deflector 5 have signal transmissions with a control device of the air-conditioner indoor unit 100, and the control device of the air-conditioner indoor unit 100 can control the movable cover plate 2 and the air deflector 5 to open or close, respectively.

In actual researches, the inventors have discovered that, due to a structural limitation of the drain pan 7, the air deflector 5 closes the air outlet 12 in the windless or wind-free feeling mode, the orthographic projection of the air deflector 5 on the drain pan 7 is located in the drain pan 7, and the condensate water on a front surface of the air deflector 5 can flow downwardly along the air deflector 5 into the drain pan 7. However, when the air deflector 5 opens the air outlet 12 to output the air into a room (for example, as illustrated in FIG. 2), the orthographic projection of the air deflector 5 on the drain pan 7 may exceed or extend beyond the drain pan 7, that is, part of the air deflector 5 may exceed a receiving range of the drain pan 7; consequently, part of the condensate water on the air deflector 5 may drop to the ground.

For this, the inventors have creatively proposed that before the air-conditioner indoor unit 100 ends the windless or wind-free feeling mode, the sweeping strip 3 to the movable cover plate 2 may be first used to sweep the condensate water on the air deflector 5 into the drain pan 7, such that when the air deflector 5 opens the air outlet 12 to output the air into the room, the condensate water on the air deflector 5 will not drop to the ground.

Figure 3:
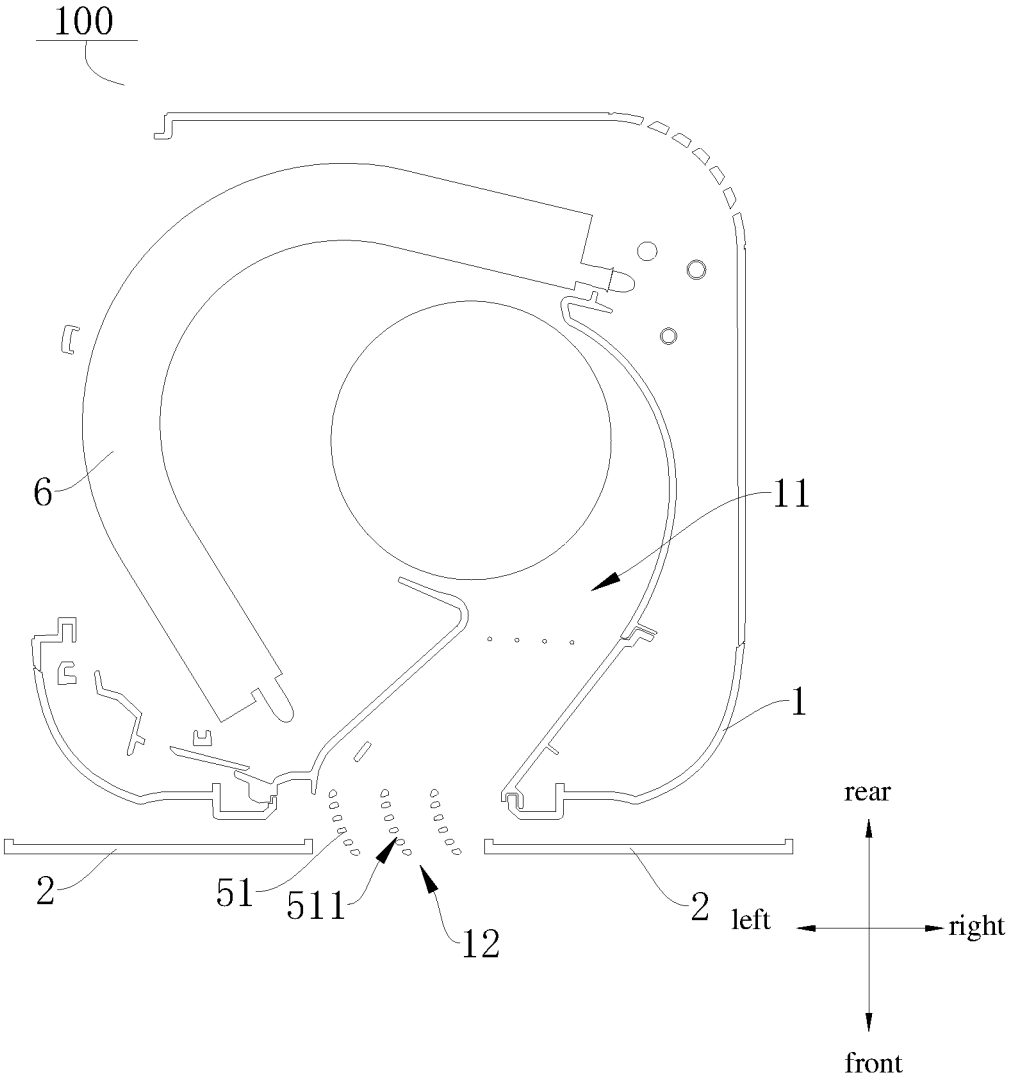
FIG. 3 is a schematic view illustrating still another state of the air-conditioner indoor unit according to FIG. 1, in which the movable cover plate is in the open state, the air deflector rotates to open the air outlet, and a rotation angle of the air deflector is greater than $\alpha_0$.

Specifically, when the air-conditioner indoor unit 100 normally operates (for example, cooling), as illustrated in FIG. 3, the two movable cover plates 2 move away from each other to a position where the air outlet 12 is opened, and then the air deflector 5 partly opens the air outlet 12. Under the action of the wind wheel, the air after exchanging heat with the indoor heat exchanger 6 can be discharged through the air duct 11 to the air outlet 12 and flow into the indoor space through the air outlet 12 to adjust the temperature of the indoor environment. When the windless or wind-free feeling mode of the air-conditioner indoor unit 100 needs to be started by the user, a control method of the air-conditioner indoor unit 100 may include the following steps. At step S10, the air-conditioner indoor unit 100 starts the windless or wind-free feeling mode. At step S20, when receiving an instruction of ending the windless or wind-free feeling mode, the air-conditioner indoor unit 100 controls the movable cover plate 2 to move back and forth between closing the air outlet 12 and opening the air outlet 12 for n times, so as to drive the sweeping strip 3 to move to sweep the condensate water on the surface of the air deflector 5, and in this process, the sweeping strip 3 contacts with the air deflector 5 to sweep the condensate water on the air deflector 5 into the drain pan 7. At step S30, the windless or wind-free feeling mode is ended.

Figure 10:
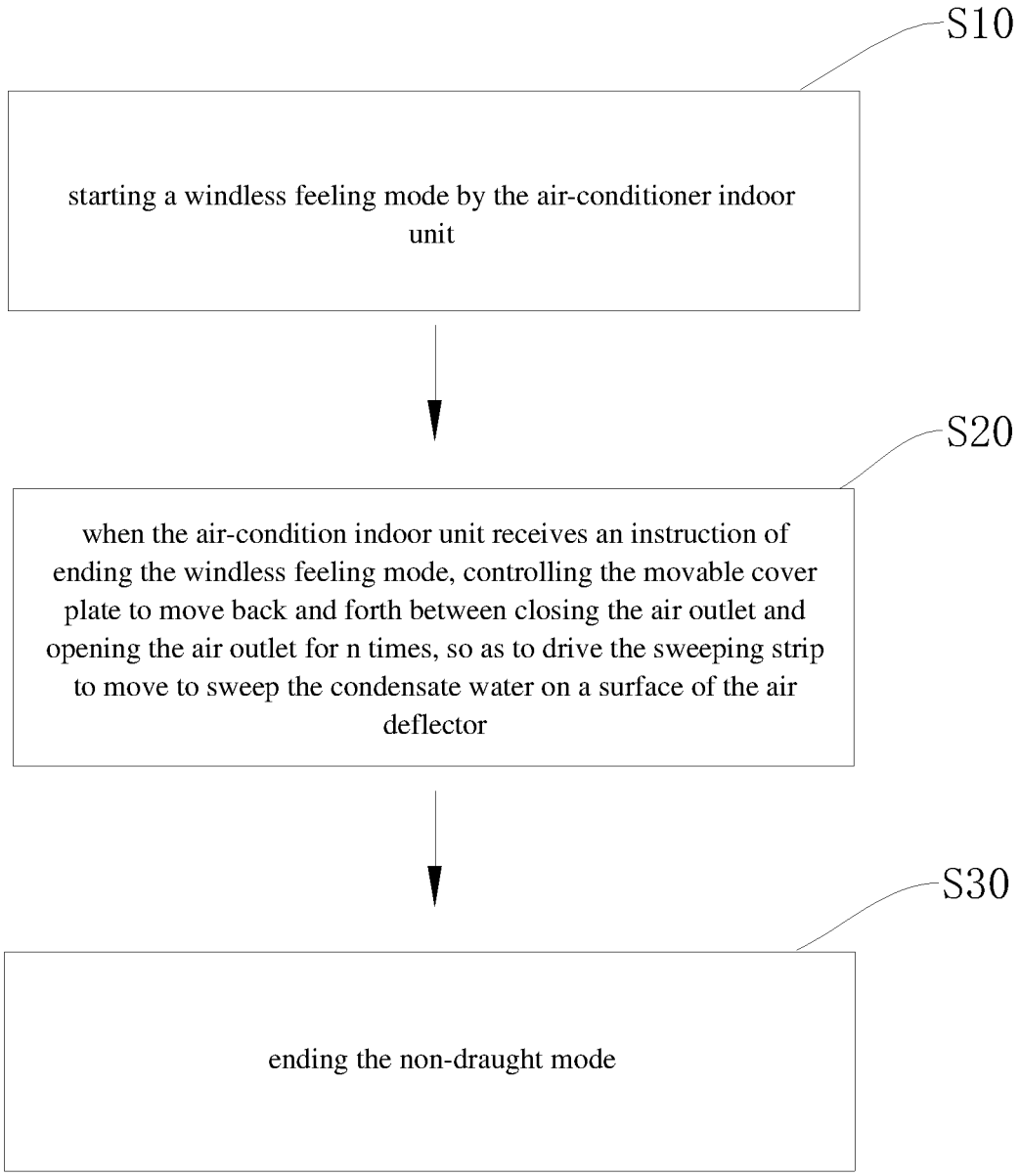
FIG. 10 is a flow chart of a control method for an air-conditioner indoor unit according to some embodiments of the present disclosure, in which a sweeping strip is used to clean condensate water.

As illustrated in FIG. 10, the control method of the air-conditioner indoor unit 100 according to embodiments of the present disclosure may include the following steps.

At step S10, the air-conditioner indoor unit 100 starts the windless or wind-free feeling mode. For example, a windless-feeling-mode key may be arranged on a remote controller matched with the air-conditioner indoor unit 100, and the user may press the windless-feeling-mode key to start the windless feeling mode.

At step S20, when receiving an instruction of ending the windless or wind-free feeling mode, the air-conditioner indoor unit 100 controls the movable cover plate 2 to move back and forth between closing the air outlet 12 and opening the air outlet 12 (the movable cover plate 2 is moved from a position in FIG. 1 to a position in FIG. 3, and then moved again to the position in FIG. 1) for n times, so as to drive the sweeping strip 3 to move to sweep the condensate water on the surface of the air deflector 5, in which n>0. It should be understood that the air-conditioner indoor unit 100 may receive the instruction of ending the windless or wind-free feeling mode in the following two conditions. For example, a windless-feeling-mode ending key may be arranged on the remote controller matched with the air-conditioner indoor unit 100, and the user can press the windless-feeling-mode ending key to send the instruction of ending the windless feeling mode. The air-conditioner indoor unit 100 receives the instruction of ending the windless feeling mode to perform an action at step S20. For another example, according to the temperature of the indoor environment, the humidity of the indoor environment, or an operation time of the windless feeling mode, the control device of the air-conditioner indoor unit 100 may determine whether to send the instruction of ending the windless feeling mode to the air-conditioner indoor unit 100. When the environment temperature, the humidity of the indoor environment, or the operation time of the windless feeling mode reaches a predetermined value, the control device sends the instruction of ending the windless feeling mode, and the air-conditioner indoor unit 100 receives the instruction of ending the windless feeling mode to perform the action at step S20.

At step S30, the windless or wind-free feeling mode is ended. For example, when the movable cover plate 2 reaches the position where the air outlet 12 is opened, the air deflector 5 at least partly opens the air outlet 12 to output the air to the indoor environment, and the air-conditioner indoor unit 100 ends the windless or wind-free feeling mode.

Therefore, when receiving the instruction of ending the windless feeling mode, the air-conditioner indoor unit 100 controls the movable cover plate 2 to move back and forth between closing the air outlet 12 and opening the air outlet 12 for n times, so as to drive the sweeping strip 3 to move to sweep the condensate water on the surface of the air deflector 5, such that the air output with the windless feeling of the air-conditioner indoor unit 100 can be realized without sacrificing a cooling capacity of the air conditioner, and the condensate water on the air deflector 5 can be prevented from dropping to the ground.

In the control method of the air-conditioner indoor unit 100 according to the embodiments of the present disclosure, when receiving the instruction of ending the windless feeling mode, the air-conditioner indoor unit 100 controls the movable cover plate 2 to move back and forth between closing the air outlet 12 and opening the air outlet 12 for n times, so as to drive the sweeping strip 3 to move to sweep the condensate water on the surface of the air deflector 5, such that the air output with the windless feeling of the air-conditioner indoor unit 100 can be realized without sacrificing the cooling capacity of the air conditioner, and the condensate water on the air deflector 5 can be prevented from dropping to the ground.

As illustrated in FIG. 10, in some embodiments of the present disclosure, n satisfies: $1 \leq n \leq 3$. Therefore, on one hand, the number n of times of the movable cover plate 2 moving back and forth between closing the air outlet 12 and opening the air outlet 12 is not too small, so as to avoided a poor effect of the sweeping strip 3 sweeping the condensate water on the surface of the air deflector 5. On the other hand, the number n of times of the movable cover plate 2 moving back and forth between closing the air outlet 12 and opening the air outlet 12 is not too large, so as to avoid a waste of time and energy. For example, n may be 1, 2, or 3.

Figure 11:
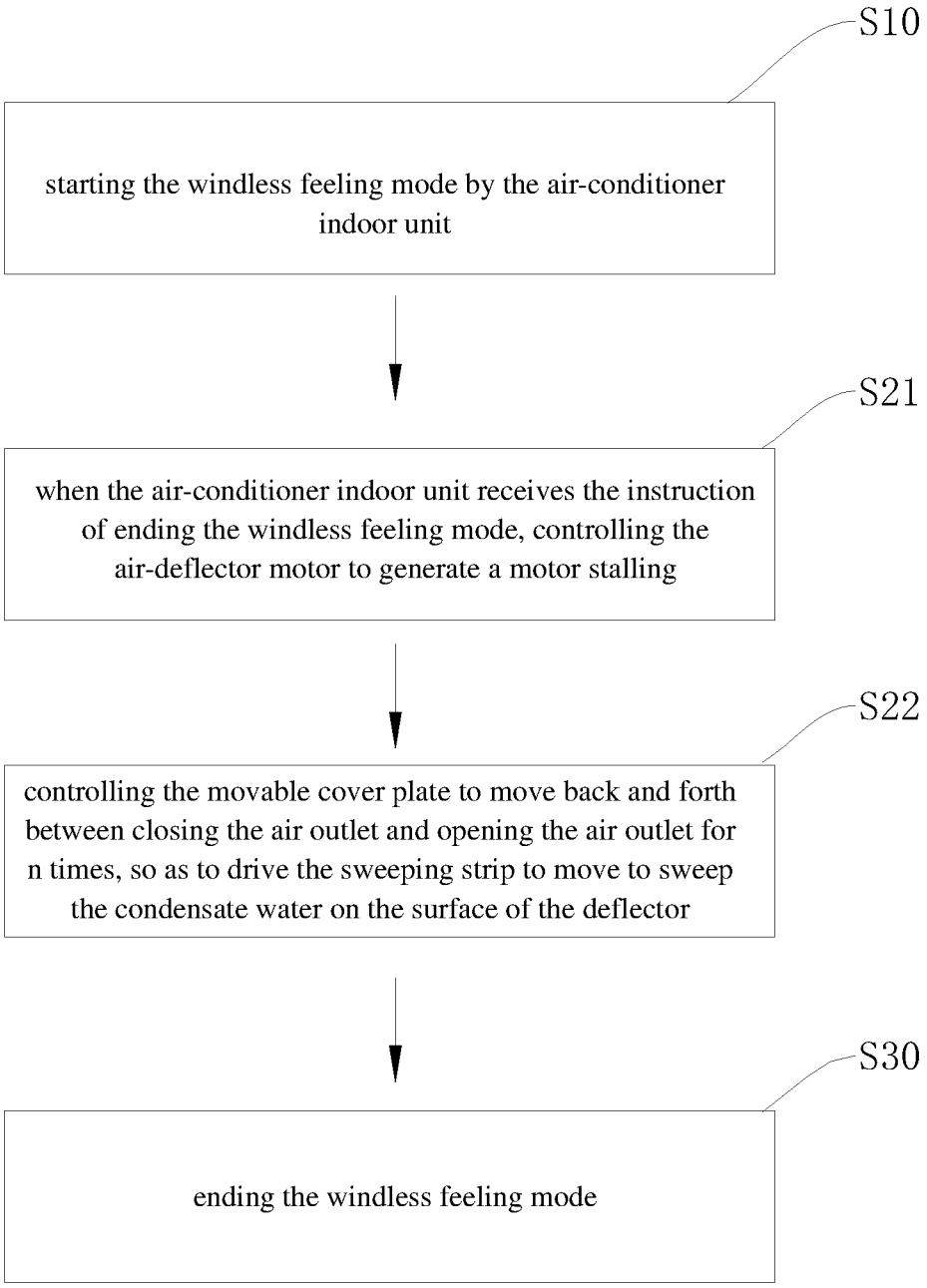
FIG. 11 is a flow chart of a control method for an air-conditioner indoor unit according to some other embodiments of the present disclosure, in which a sweeping strip is used to clean condensate water.

As illustrated in FIG. 11, in some embodiments of the present disclosure, step S20 includes followings.

At step S21, when receiving the instruction of ending the windless feeling mode, the air-conditioner indoor unit 100 controls an air-deflector motor to generate a motor stalling.

Figure 4:
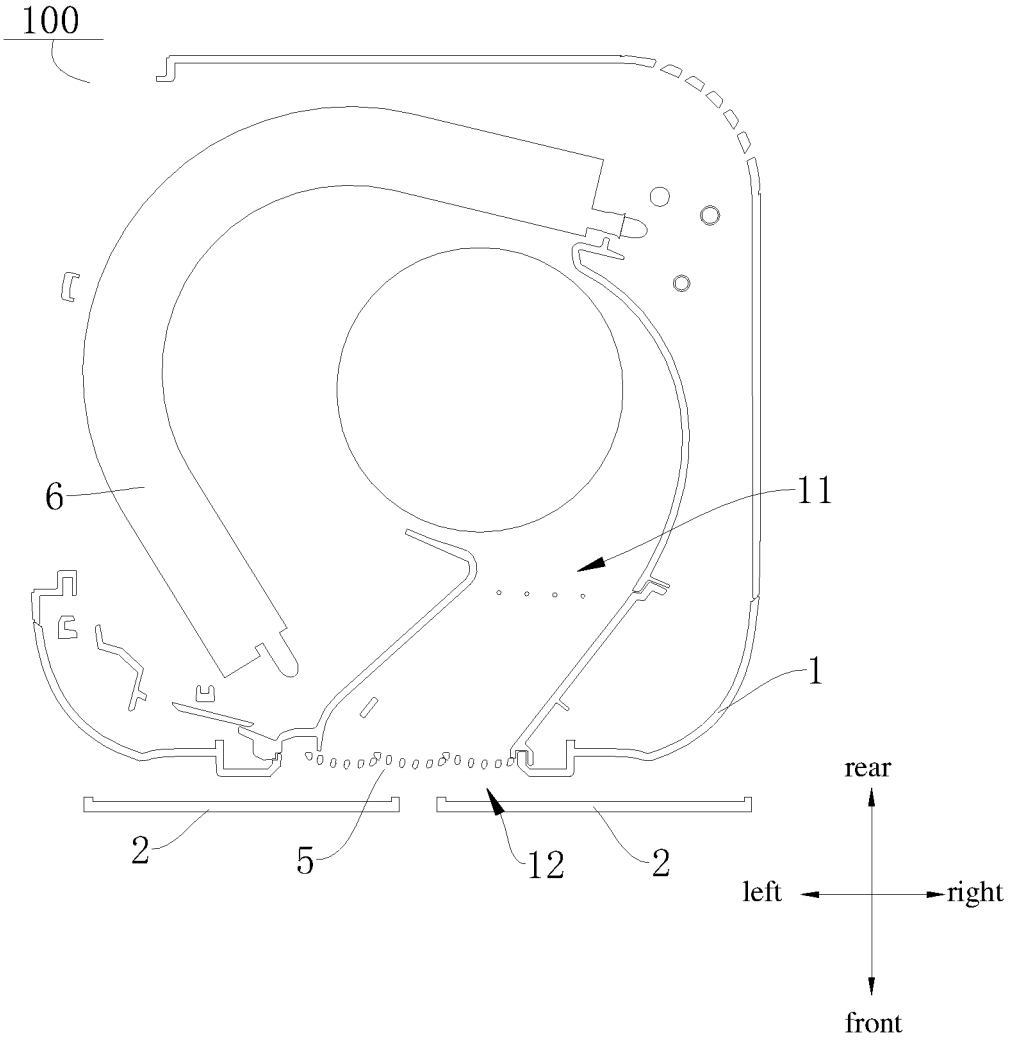
FIG. 4 is a schematic view illustrating yet another state of the air-conditioner indoor unit according to FIG. 1, in which the movable cover plate is in a closed state, and the air deflector closes the air outlet.
Figure 5:
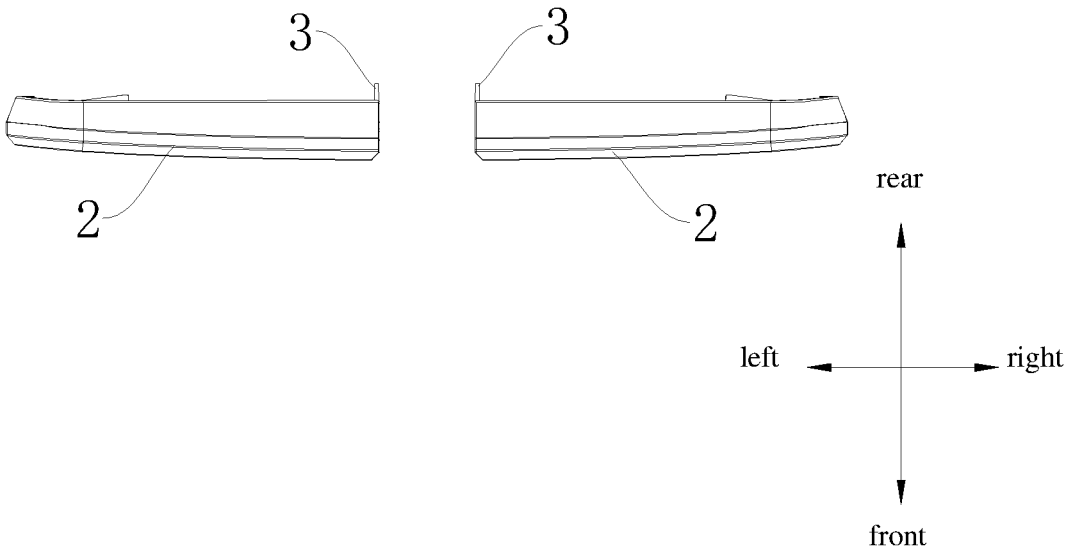
FIG. 5 is a schematic view of a movable cover plate and a sweeping strip according to an embodiment of the present disclosure.

At step S22, the air-conditioner indoor unit 100 controls the movable cover plate 2 to move back and forth between closing the air outlet 12 and opening the air outlet 12 (for example, the movable cover plate 2 moves from the position in FIG. 1 to the position in FIG. 4, and then to the position in FIG. 1) for n times, so as to drive the sweeping strip 3 to move to sweep the condensate water on the surface of the air deflector 5.

It should be understood that, first at step S21, when receiving the instruction of ending the windless feeling mode, the air-conditioner indoor unit 100 controls the air-deflector motor to generate the motor stalling so as to drive the air deflector 5 to vibrate, such that the condensate water on the air deflector 5 drops into the drain pan 7 under the action of the vibration of the air deflector 5 and the gravity of the condensate water, and next at step S22, the air-conditioner indoor unit 100 controls the movable cover plate 2 to move back and forth between closing the air outlet 12 and opening the air outlet 12 for n times, so as to drive the sweeping strip 3 to move to sweep the condensate water on the surface of the air deflector 5, which helps to fully sweep the condensate water on the surface of the air deflector 5 when the air-conditioner indoor unit 100 ends the windless feeling mode, thereby avoiding the condensate water on the air deflector 5 from dropping to the ground, and hence improving the use experience of the user.

Figure 12:
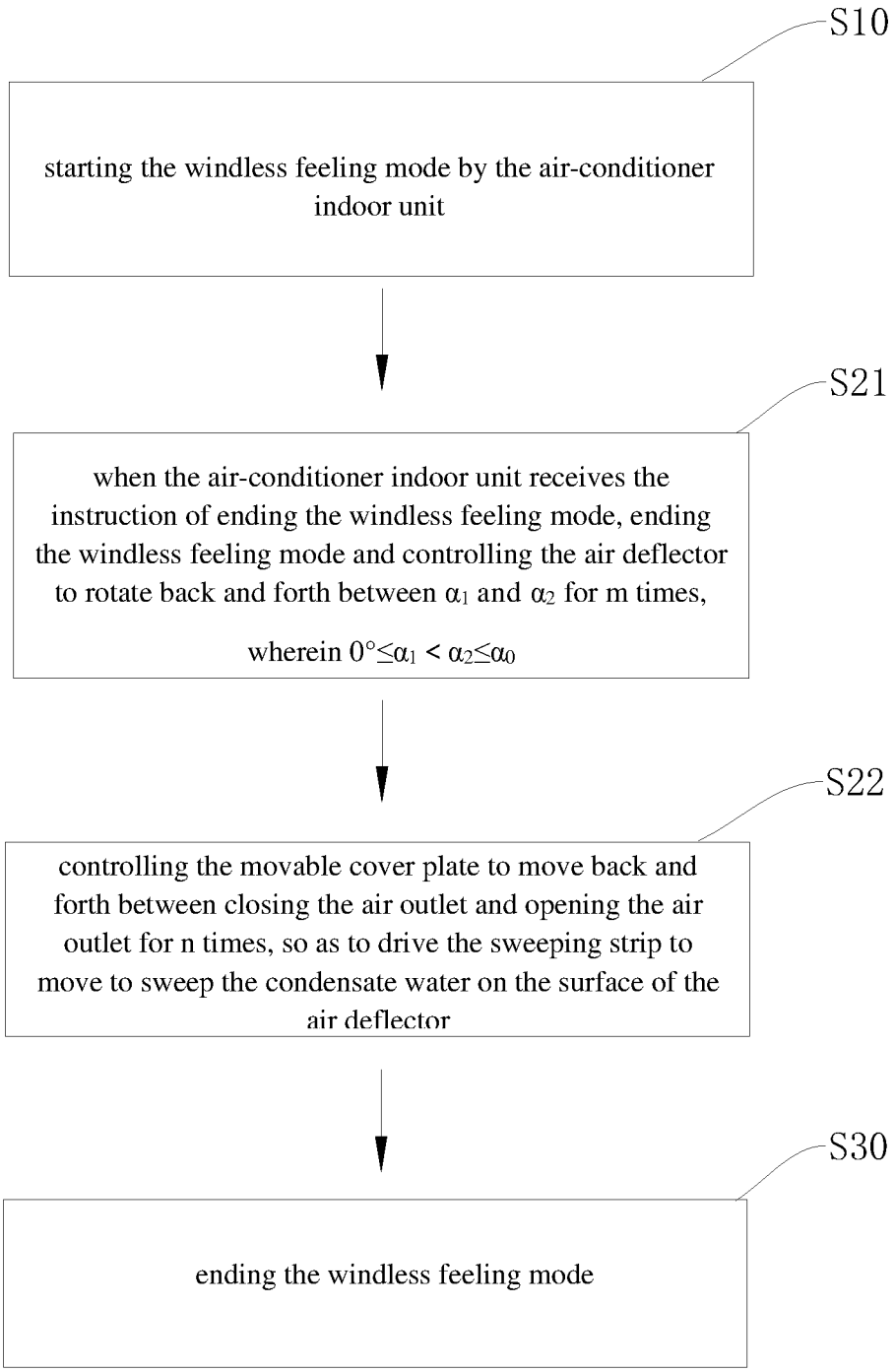
FIG. 12 is a flow chart of a control method for an air-conditioner indoor unit according to yet some other embodiments of the present disclosure, in which a sweeping strip is used to clean condensate water.

As illustrated in FIG. 12, in some embodiments of the present disclosure, step S20 includes followings.

At step S21, when receiving the instruction of ending the windless feeling mode, the air-conditioner indoor unit 100 ends the windless feeling mode and controls the air deflector 5 to rotate back and forth between $\alpha_1$ and $\alpha_2$ for m times, in which $0° \leq \alpha_1 < \alpha_2 \leq \alpha_0$.

It should be understood that the air-conditioner indoor unit 100 may receive the instruction of ending the windless feeling mode in the following two conditions. For example, the windless-feeling-mode ending key may be arranged on the remote controller matched with the air-conditioner indoor unit 100, the user may press the windless-feeling-mode ending key to send the instruction of ending the windless feeling mode, and the air-conditioner indoor unit 100 receives the instruction of ending the windless feeling mode to perform step S21 and subsequent step S22. As another example, according to the temperature of the indoor environment, the humidity of the indoor environment, or the operation time of the windless feeling mode, the control device of the air-conditioner indoor unit 100 judges whether to send the instruction of ending the windless feeling mode to the air-conditioner indoor unit 100. When the environment temperature, the humidity of the indoor environment, or the operation time of the windless feeling mode reaches the predetermined value, the control device sends the instruction of ending the windless feeling mode, and the air-conditioner indoor unit 100 receives the instruction of ending the windless feeling mode to perform step S21 and subsequent step S22.

At step S22, the windless feeling mode is entered and the movable cover plate 2 is controlled to move back and forth between closing the air outlet 12 and opening the air outlet 12 for n times, so as to drive the sweeping strip 3 to move to sweep the condensate water on the surface of the air deflector 5, and in this process, the sweeping strip 3 contacts with the air deflector 5 to sweep the condensate water on the air deflector 5 into the drain pan 7.

It should be understood that, at step S21, when receiving the instruction of ending the windless feeling mode, the air-conditioner indoor unit 100 controls the air deflector 5 to rotate back and forth between $\alpha_1$ and $\alpha_2$ for m times, such that the condensate water on the air deflector 5 drops into the drain pan 7 under the action of a power generated by a rotation speed of the air deflector 5 and the gravity of the condensate water, and at step S22, the windless feeling mode is entered, that is, the air deflector 5 closes the air outlet 12, and then the movable cover plate 2 is controlled to move back and forth between closing the air outlet 12 and opening the air outlet 12 for n times, so as to drive the sweeping strip 3 to move to sweep the condensate water on the surface of the air deflector 5. Therefore, the air output with the windless feeling of the air-conditioner indoor unit 100 can be realized without sacrificing the cooling capacity of the air conditioner, and it is possible to fully sweep the condensate water on the surface of the air deflector 5 when the air-conditioner indoor unit 100 ends the windless feeling mode, so as to prevent the condensate water on the air deflector 5 from dropping to the ground, thus improving the use experience of the user.

As illustrated in FIG. 12, in some embodiments of the present disclosure, m satisfies: $2 \leq m \leq 5$. Therefore, on one hand, the number m of times of the air deflector 5 rotating back and forth between $\alpha_1$ and $\alpha_2$ is not too small, and thus it is avoided that too little condensate water drops into the drain pan 7 under the action of the power generated by the rotation speed of the air deflector 5 and the gravity of the condensate water. On the other hand, the number m of times of the air deflector 5 rotating back and forth between $\alpha_1$ and $\alpha_2$ is not too large, thereby avoiding the waste of time and energy. For example, m may be two, three, four, or five.

As illustrated in FIG. 12, in some embodiments of the present disclosure, $\alpha_0$ satisfies: $\alpha_0 \leq 20°$. Therefore, the orthographic projection of the air deflector 5 on the drain pan 7 is completely located in the drain pan 7, such that when the air deflector 5 rotates back and forth between $\alpha_1$ and $\alpha_2$, the condensate water falling off from the surface of the air deflector 5 can completely drop into the drain pan 7, thus avoiding the condensate water on the air deflector 5 from dropping to the ground when the air deflector 5 rotates back and forth between $\alpha_1$ and $\alpha_2$. For example, $\alpha_0$ may be 5°, 10°, 15°, or 20°.

As illustrated in FIG. 12, in some embodiments of the present disclosure, $\alpha_1 = 0°$, $\alpha_2 = \alpha_0$. Therefore, an angle of the air deflector 5 rotating back and forth is maximal at step S20, which facilitates the condensate water to drop into the drain pan 7 under the action of the power generated by the rotation speed of the air deflector 5 and the gravity of the condensate water.

As illustrated in FIG. 12, in some embodiments of the present disclosure, $\alpha_1$ satisfies: $0° \leq \alpha_1 \leq 5°$. Therefore, it can be ensured that the angle of the air deflector rotating back and forth at step S20 is large, which thus facilitates the condensate water to drop into the drain pan 7 under the action of the power generated by the rotation speed of the air deflector 5 and the gravity of the condensate water. For example, $\alpha_1$ may be 0°, 1°, 2°, 3°, 4°, or 5°.

Figure 13:
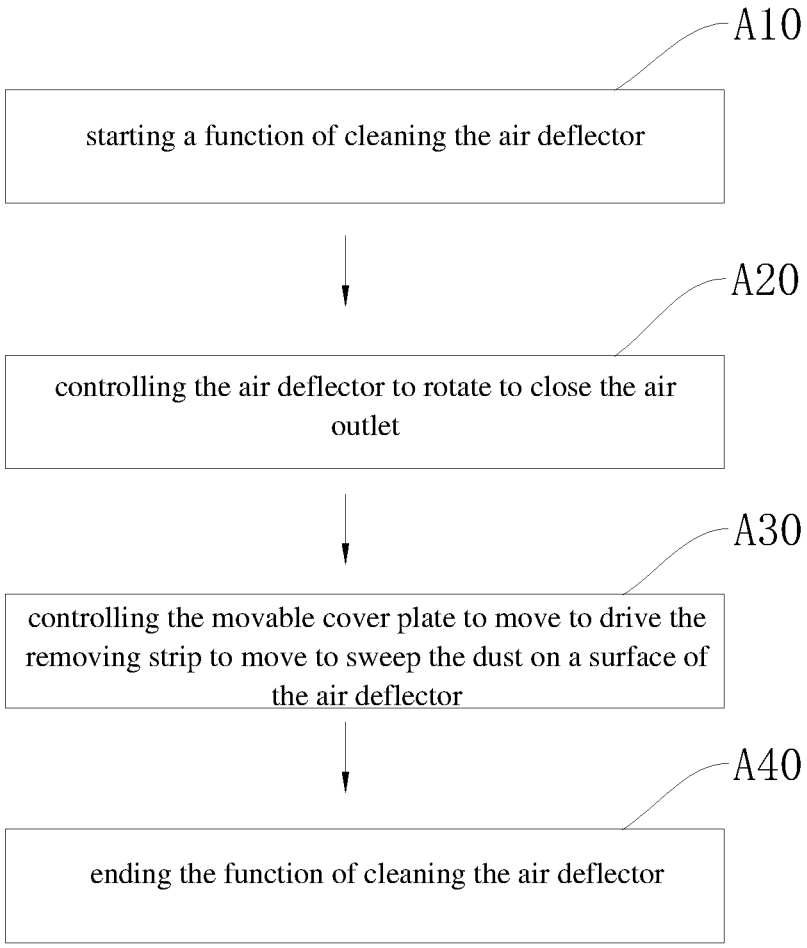
FIG. 13 is a flow chart of a control method for an air-conditioner indoor unit according to some embodiments of the present disclosure, in which a sweeping strip is used to clean dust.

As illustrated in FIG. 13, the control method of the air-conditioner indoor unit according to the embodiments of the present disclosure may include the following steps.

At step A10, a function of cleaning the air deflector 5 is turned on. For example, a cleaning function key may be arranged on the remote controller matched with the air-conditioner indoor unit 100, and the user may press the cleaning function key to turn on the function of cleaning the air deflector 5.

At step A20, the air deflector 5 is controlled to rotate to close the air outlet 12 (for example, a position of the air deflector as illustrated in FIG. 1).

At step A30, the movable cover plate 2 is controlled to move, so as to drive the sweeping strip 3 to move to sweep the dust on the surface of the air deflector 5. For example, when the air-conditioner indoor unit 100 is in a power-on state, the movable cover plate 2 opens the air outlet 12, the movable cover plate 2 may be controlled to move to close the air outlet 12, and then to move again to open the air outlet 12 (the movable cover plate moves from the position in FIG. 1 to the position in FIG. 4, and then moves again to the position in FIG. 1), so as to drive the sweeping strip 3 to move to sweep the dust on the surface of the air deflector 5. For another example, when the air-conditioner indoor unit 100 is in a power-off state, the movable cover plate 2 closes the air outlet, the movable cover plate 2 may be controlled to move to open the air outlet 12 (the movable cover plate 2 moves from the position in FIG. 4 to the position in FIG. 1), so as to drive the sweeping strip 3 to move to sweep the dust on the surface of the air deflector 5.

At step A40, the function of cleaning the air deflector 5 is ended. Therefore, by controlling the movable cover plate 2 to move so as to control the sweeping strip 3 to move, the dust on the surface of the air deflector 5 can be swept, such that the air-conditioner indoor unit 100 is prevented from being disassembled when the dust is to be removed from the air deflector 5, and it is not necessary to remove the dust from the air deflector 5 manually, thus improving the use experience of the user.

In the control method of the air-conditioner indoor unit 100 according to the embodiments of the present disclosure, by controlling the movable cover plate 2 to move so as to drive the sweeping strip 3 to move to sweep the dust on the surface of the air deflector 5, the air-conditioner indoor unit 100 is prevented from being disassembled when the dust is to be removed from the air deflector 5, and it is not necessary to remove the dust from the air deflector 5 manually, thus improving the use experience of the user.

Figure 14:
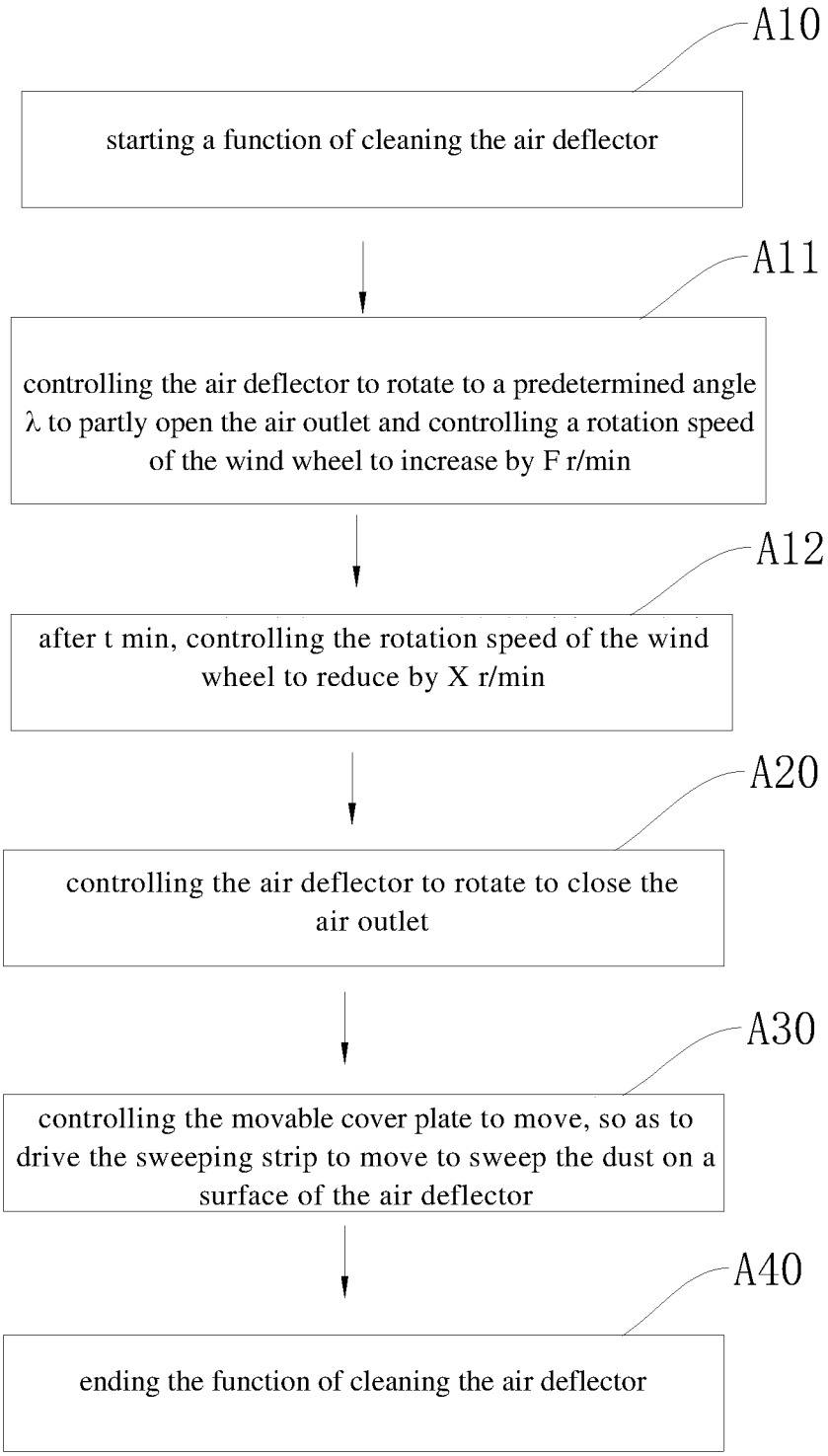
FIG. 14 is a flow chart of a control method for an air-conditioner indoor unit according to some other embodiments of the present disclosure, in which a sweeping strip is used to clean dust.

As illustrated in FIG. 14, in some embodiments of the present disclosure, step A11 is further included between step A10 and step A20. At step A11, the air deflector 5 is controlled to rotate to a predetermined angle λ (for example, an angle to which the air deflector 5 rotates as illustrated in FIG. 2) so as to partly open the air outlet 12, and a rotation speed of the wind wheel is controlled to increase by F r/min, in which F>0, and the predetermined angle λ may be interpreted as an angle by which the air deflector 5 rotates from a position where the air deflector 5 closes the air outlet 12 to a position where the air deflector 5 opens the air outlet 12. Therefore, through increasing the rotation speed of the wing rotor, a flow speed of the airflow in the air duct 11 can be increased, such that the airflow can blow away part of the dust attached on the air deflector 5 while flowing to the air outlet 12 through the air duct 11, thus improving an dust removing effect. Moreover, the amount of the dust to be swept by the sweeping strip 3 at step A30 can be reduced, thereby improving the service life of the sweeping strip 3.

Optionally, as illustrated in FIG. 14, the control method further incudes step A12 between step A11 and step A20. At step A12, after t min, the rotation speed of the wind wheel is controlled to reduce by X r/min, in which X≥F, t>0. It should be understood that, at step A20 after step A11, the air deflector 5 needs to be controlled to rotate to open the air outlet 12. In order to ensure the operation safety of the air-conditioner indoor unit 100 at step A20, the rotation speed of the wind wheel needs to be reduced in advance. Thus, by adding step A11, an excessive wind pressure in the air-conditioner indoor unit 100 can be avoided at step A20, thereby improving the safety in a process of the air deflector 5 rotating to close the air outlet 12.

As illustrated in FIG. 14, in some optional embodiments of the present disclosure, at step A12, after t min, the rotation speed of the wind wheel is controlled to reduce to the lowest rotation speed. It should be understood that, at step A30 (the sweeping strip 3 moves to sweep the dust on the surface of the air deflector 5), through controlling the rotation speed of the wind wheel to reduce to the lowest rotation speed in advance, the airflow blown from the air duct 11 can be prevented from blowing the dust swept by the sweeping strip 3 to the user at step A30. Of course, the present disclosure is not limited to this. Alternatively, at step A12, after t min, the rotation speed of the wind wheel is controlled to reduce to zero. That is, at step A12, after t min, there is no airflow in the air duct 11 to flow to the indoor space, and thus it is avoided that the airflow blown from the air duct 11 blows the dust swept by the sweeping strip 3 to the user.

Optionally, as illustrated in FIG. 14, 5≤t≤25. Therefore, on one hand, the time t for which the airflow blown from the air duct 11 blows to the air deflector 5 is not too small, thereby ensuring a cleaning effect of the airflow on the dust on the air deflector 5 at step A11. On the other hand, the time t is not too large, the waste of electric energy can be avoided, thereby saving the cost. For example, t may be 5, 10, 15, 20, or 25. A specific valve of t can be adjusted and designed according to a specific specification of the air-conditioner indoor unit 100.

As illustrated in FIG. 14, in some optional embodiments of the present disclosure, 25≤F≤70. Therefore, on one hand, F r/min increased by the rotation speed of the wind wheel at step A11 is not too small, thereby improving the cleaning effect of the airflow flowing from the air duct 11 to the air outlet 12 on part of the dust attached on the air deflector 5. On the other hand, F r/min increased by the rotation speed of the wind wheel at step A11 is not too large, such that an energy consumption of the air-conditioner indoor unit 100 is not too large, thus ensuring the operation cost of the air-conditioner indoor unit 100. For example, F may be 25, 35, 45, 55, or 70. A specific valve of F can be adjusted and designed according to the specific specification of the air-conditioner indoor unit 100.

Optionally, 45°≤λ≤90°. Therefore, the amount of the air output of the air-conditioner indoor unit 100 at step A11 can be ensured, thereby ensuring that part of the dust attached on the air deflector 5 can be blown away by the airflow flowing from the air duct 11 to the air outlet 12.

As illustrated in FIG. 14, in some optional embodiments of the present disclosure, at step A30, the movable cover plate 2 is controlled to move back and forth between opening the air outlet 12 and closing the air outlet 12 for k times, in which k>0. It should be understood that at step A30, in the process of the movable cover plate 2 moving back and forth between opening the air outlet 12 and closing the air outlet 12 for k times, the sweeping strip 3 moves back and forth for k times along with the movable cover plate 2, so as to sweep the dust on the surface of the air deflector 5, such that the cleaning effect on the air deflector 5 is improved, and the next operation of the air-conditioner indoor unit 100 is not affected. For example, the number of times of the movable cover plate 2 moving back and forth between opening the air outlet 12 and closing the air outlet 12 is one by default, and the user may also set the number k of times of the movable cover plate 2 moving back and forth between opening the air outlet 12 and closing the air outlet 12. For example, k may be set as two, three, four, or five, and so on. Therefore, the user can personalize the number of times of the sweeping strip 3 removing the dust, such that the sense of science and technology of the air-conditioner indoor unit 100 can be enhanced, and the user experience can be improved.

In some embodiments of the present disclosure, when an instruction of turning on the air-conditioner indoor unit 100 is received, the function of cleaning the air deflector 5 is started. Therefore, when the air-conditioner indoor unit 100 is turned on, the dust removing of the air deflector 5 can be realized, such that the user does not need to deliberately start the function of cleaning the air deflector 5, which facilitates to keep the air deflector 5 clean during a long-term operation of the air-conditioner indoor unit 100. For example, when the air-conditioner indoor unit 100 is powered off, the movable cover plate 2 closes the air outlet 12, and the air deflector 5 is in the position where the air deflector 5 closes the air outlet 12. When the air-conditioner indoor unit 100 is powered on, the movable cover plate 2 moves to the position where the movable cover plate 2 opens the air outlet 12. In this process, the movable cover plate 2 drives the sweeping strip 3 to move to sweep the dust on the surface of the air deflector 5, and then the function of cleaning the air deflector 5 is ended. Finally, the air deflector 5 is rotated to the predetermined angle λ. The airflow in the air duct 11 after exchanging heat with the indoor heat exchanger 6 is blown to the indoor space to adjust the temperature of the indoor environment.

In some embodiments of the present disclosure, when an instruction of turning off the air-conditioner indoor unit 100 is received, the function of cleaning the air deflector 5 is first started to clean the air deflector 5, and then the air-conditioner indoor unit 100 is turned off after the function of cleaning the air deflector 5 is ended. Therefore, when the air-conditioner indoor unit 100 is to be turned off, the dust removing of the air deflector 5 can be realized, such that the user does not need to deliberately start the function of cleaning the air deflector 5, which facilitates to keep the air deflector 5 clean during a long-term operation of the air-conditioner indoor unit 100. For example, when receiving the instruction of turning off the air-conditioner indoor unit 100, the control device of the air-conditioner indoor unit 100 first controls the wind wheel to stop rotating, and then the air-conditioner indoor unit 100 starts the function of cleaning the air deflector 5. The air deflector 5 closes the air outlet 12, and then the movable cover plate 2 moves from the position where the movable cover plate 2 opens the air outlet 12 to the position where the movable cover plate 2 closes the air outlet 12. In this process, the movable cover plate 2 drives the sweeping strip 3 to move to sweep the dust on the surface of the air deflector 5, and finally the function of cleaning the air deflector 5 is ended.

In the description of the present disclosure, reference throughout this specification to "an embodiment," "some embodiments," "an exemplary embodiment", "an example," "a specific example," or "some examples" means that a particular feature, structure, material, or characteristic described in connection with the embodiment or example is included in at least one embodiment or example of the present disclosure. In the specification, the appearances of the above-mentioned terms are not necessarily referring to the same embodiment or example of the present disclosure. Furthermore, the particular features, structures, materials, or characteristics may be combined in any suitable manner in one or more embodiments or examples.

Although embodiments of the present disclosure have been shown and described, it shall be appreciated by those skilled in the art that various changes, modifications, alternatives, and variations can be made in the embodiments without departing from principles and purposes of the present disclosure. The scope of the present disclosure is defined by claims or their equivalents.

What is claimed is:

1. A control method for an air-conditioner indoor unit, wherein the air-conditioner indoor unit comprises a housing, a wind wheel, an air deflector, a movable cover plate, and a sweeping strip, the housing having an air outlet, the air deflector being rotatably arranged at the air outlet, the movable cover plate being movably arranged at a front side of the housing to open or close the air outlet, and the sweeping strip being attached to the movable cover plate and configured to sweep dust on the air deflector;

the control method comprising:

starting a function of cleaning the air deflector;

controlling the air deflector to rotate to close the air outlet;

controlling the movable cover plate to move, so as to drive the sweeping strip to move to sweep the dust on a surface of the air deflector; and ending the function of cleaning the air deflector.

2. The control method for the air-conditioner indoor unit according to claim 1, further comprising, after the starting the function of cleaning the air deflector:

controlling the air deflector to rotate to a predetermined angle λ to partly open the air outlet and controlling a rotation speed of the wind wheel to increase by F r/min, wherein F>0.

3. The control method for the air-conditioner indoor unit according to claim 2, further comprising, after the controlling the air deflector to rotate to the predetermined angle λ:

after t min, controlling the rotation speed of the wind wheel to reduce by X r/min, wherein X≥F, t>0.

4. The control method for the air-conditioner indoor unit according to claim 3, wherein, after the t min, the rotation speed of the wind wheel is controlled to reduce to a lowest rotation speed.

5. The control method for the air-conditioner indoor unit according to claim 4, wherein 5≤t≤25.

6. The control method for the air-conditioner indoor unit according to claim 2, wherein 25≤F≤70.

7. The control method for the air-conditioner indoor unit according to claim 2, wherein 45°≤λ≤90°.

8. The control method for the air-conditioner indoor unit according to claim 1, wherein the controlling the movable cover plate to move comprises controlling the movable cover plate to move back and forth between opening the air outlet and closing the air outlet for k times, k>0.

9. The control method for the air-conditioner indoor unit according to claim 1, wherein when an instruction of turning on the air-conditioner indoor unit is received, the function of cleaning the air deflector is started.

10. The control method for the air-conditioner indoor unit according to claim 1, wherein when an instruction of turning off the air-conditioner indoor unit is received, the function of cleaning the air deflector is first started to clean the air deflector, and the air-conditioner indoor unit is turned off after the function of cleaning the air deflector is ended.

* * * * *